US007871332B2

(12) United States Patent
Knez

(10) Patent No.: US 7,871,332 B2
(45) Date of Patent: Jan. 18, 2011

(54) DEVICE FOR A TEE

(76) Inventor: Jordan Knez, Andréégatan 16, S-302 23 Halmstad (SE)

( * ) Notice: Subject to any disclaimer, the term of this patent is extended or adjusted under 35 U.S.C. 154(b) by 70 days.

(21) Appl. No.: 12/226,008

(22) PCT Filed: Mar. 29, 2007

(86) PCT No.: PCT/SE2007/000306

§ 371 (c)(1),
(2), (4) Date: Nov. 13, 2008

(87) PCT Pub. No.: WO2007/114765

PCT Pub. Date: Oct. 11, 2007

(65) Prior Publication Data

US 2009/0312112 A1 Dec. 17, 2009

(30) Foreign Application Priority Data

Apr. 3, 2006 (SE) ..... 0600751

(51) Int. Cl.
*A63B 69/36* (2006.01)

(52) U.S. Cl. ..... 473/132; 473/137

(58) Field of Classification Search ..... 473/132–137, 473/387, 396, 397, 401
See application file for complete search history.

(56) References Cited

U.S. PATENT DOCUMENTS

| | | | | | |
|---|---|---|---|---|---|
| 1,633,686 | A | * | 6/1927 | Stone | 473/401 |
| 1,819,896 | A | * | 8/1931 | Irish | 473/397 |
| 1,866,143 | A | * | 7/1932 | Willey | 473/397 |
| 1,888,256 | A | | 11/1932 | Baumgartner | |
| 2,457,670 | A | * | 12/1948 | Harvey | 473/397 |
| 3,298,694 | A | * | 1/1967 | Turnau et al. | 473/135 |
| 3,378,263 | A | * | 4/1968 | Turnau et al. | 473/135 |
| 3,519,275 | A | * | 7/1970 | Meierjohan | 473/136 |
| 3,533,631 | A | * | 10/1970 | Hladek | 473/136 |
| 3,738,662 | A | * | 6/1973 | Hodgin | 473/133 |
| 3,966,213 | A | | 6/1976 | Bradley | |
| 4,355,811 | A | * | 10/1982 | Williams, Sr. | 473/136 |
| 4,645,208 | A | * | 2/1987 | Morabeto | 473/397 |
| 5,297,797 | A | * | 3/1994 | Lamontagne | 473/133 |
| 5,346,222 | A | * | 9/1994 | Luther, Sr. | 473/137 |
| 5,411,267 | A | * | 5/1995 | Burks et al. | 473/133 |
| 5,464,223 | A | * | 11/1995 | Dermott | 473/134 |
| 5,611,737 | A | * | 3/1997 | Rau et al. | 473/137 |
| 5,645,491 | A | * | 7/1997 | Brown | 473/135 |
| 6,106,405 | A | | 8/2000 | Fox | |
| 6,899,644 | B1 | * | 5/2005 | Song et al. | 473/397 |
| 2008/0146383 | A1 | * | 6/2008 | Dandelius | 473/397 |

* cited by examiner

*Primary Examiner*—Steven Wong
(74) *Attorney, Agent, or Firm*—McGinn IP Law Group, PLLC

(57) ABSTRACT

An apparatus at a driving tee for golf balls or the like, comprising a raisable and lowerable ball support a so-called peg, on which a ball may be placed for driving thereof after lifting of the ball support with the ball to the desired level above the tee, the ball support being disposed on means for switching of the ball support from a low position for loading of the ball support with a ball to a higher position of said desired ball driving level, the ball support being disposed on the switching means via positioning means which are disposed to permit pivoting of the ball support in at least the driving direction, wherein the positioning means include a substantially U-shaped bracket between whose shanks the ball support is pivotal.

7 Claims, 4 Drawing Sheets

1
2
3
4
5
6
7
8
9
10
11
12
13
14
15

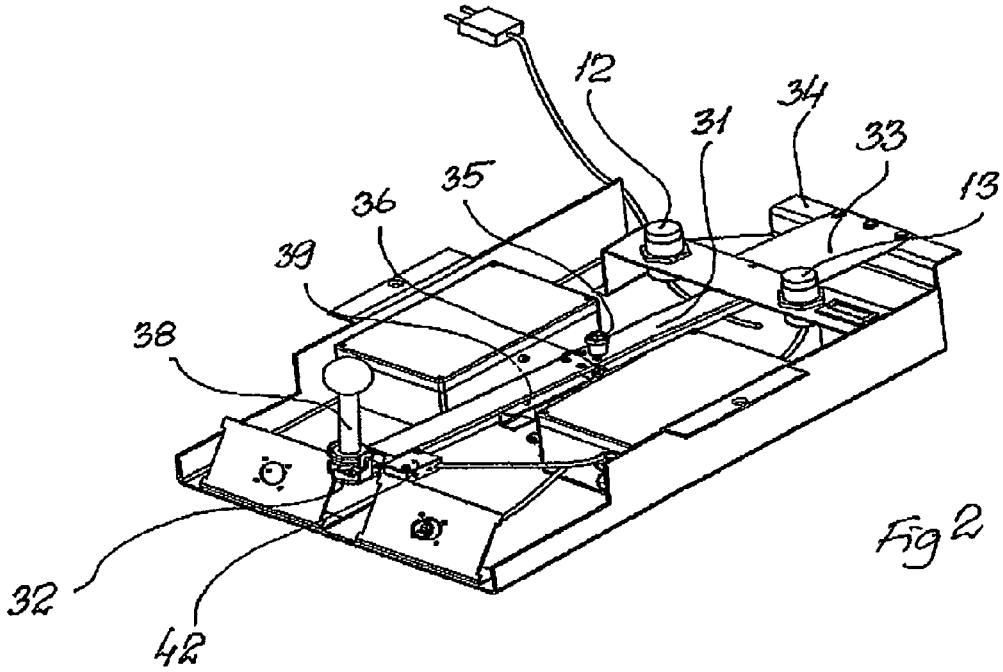
Fig 2
Fig 8
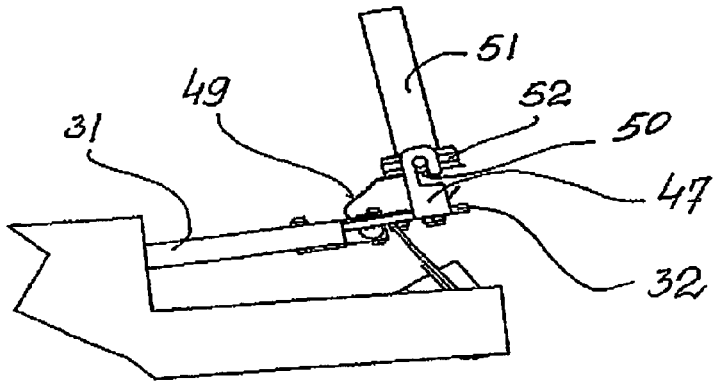

A-A (0,80:1)
A
A

DEVICE FOR A TEE

The present invention relates to an apparatus at a driving tee for golf balls.

Most driving tees or driving bays at driving ranges and similar practice facilities lack a ball support or peg which has the possibility of optional level adjustment and preferably also automatic teeing-up of the ball. These shortcomings are particularly manifest at facilities with a high load factor, where it is desirable that the time for occupying each driving bay should be as short as possible. For many people, it is further desirable to be able to avoid altering position between driving several balls in sequence, and to be readily able to select the level of the ball which is to be addressed. It has further proved to be desirable to be able to arrange a so-called pegging device preferably concealed beneath the tee site so that no ball discharging and pegging devices have any effect on the driving tee which instead substantially has the same appearance as any other driving tee whatever.

SUMMARY OF THE INVENTION

The task forming the basis of the present invention is to satisfy the above-outlined needs in the art and, to as high a degree as possible, obviate the drawbacks in prior art arrangements.

This task is solved according to the present invention in the apparatus indicated by way of introduction in that it has been given the characterising features as set forth in appended Claim 1.

As a result of the present invention, it is possible, using the apparatus disclosed by way of introduction, to select the desired level of the ball peg and also to realise an automatic pegging of the ball on the peg in that the peg, after driving of a ball, is lowered to a starting position for pegging a ball, and is thereafter raised to the desired ball level. As a result of this adjustment of the peg, there is made possible an extremely simple, fully automatic pegging of the ball thereon, in that, for example, a ball discharge tube leads to the ball peg in its low, lowered level. As a result of the present invention, it is moreover possible to position the entire apparatus completely concealed beneath the driving tee, whereby this will be given the same appearance as any other driving tee whatever. Moreover, the apparatus according to the present invention is not exposed to the elements, whereby it will be considerably more reliable in operation than prior art apparatuses. An apparatus according to the present invention further imparts to the peg or ball support considerably longer service life and permits rapid and simple replacement of any possibly damaged or worn peg.

BRIEF DESCRIPTION OF THE DRAWINGS

The present invention will now be described in greater detail hereinbelow, with reference to the accompanying drawings.

FIG. 2 is a perspective view of parts of a ball raising device according to one embodiment of the present invention.

FIG. 8 is a side elevation of a part of the device of FIG. 2 on a larger scale and without a ball.

DETAILED DESCRIPTION OF THE INVENTION

Figure 1:
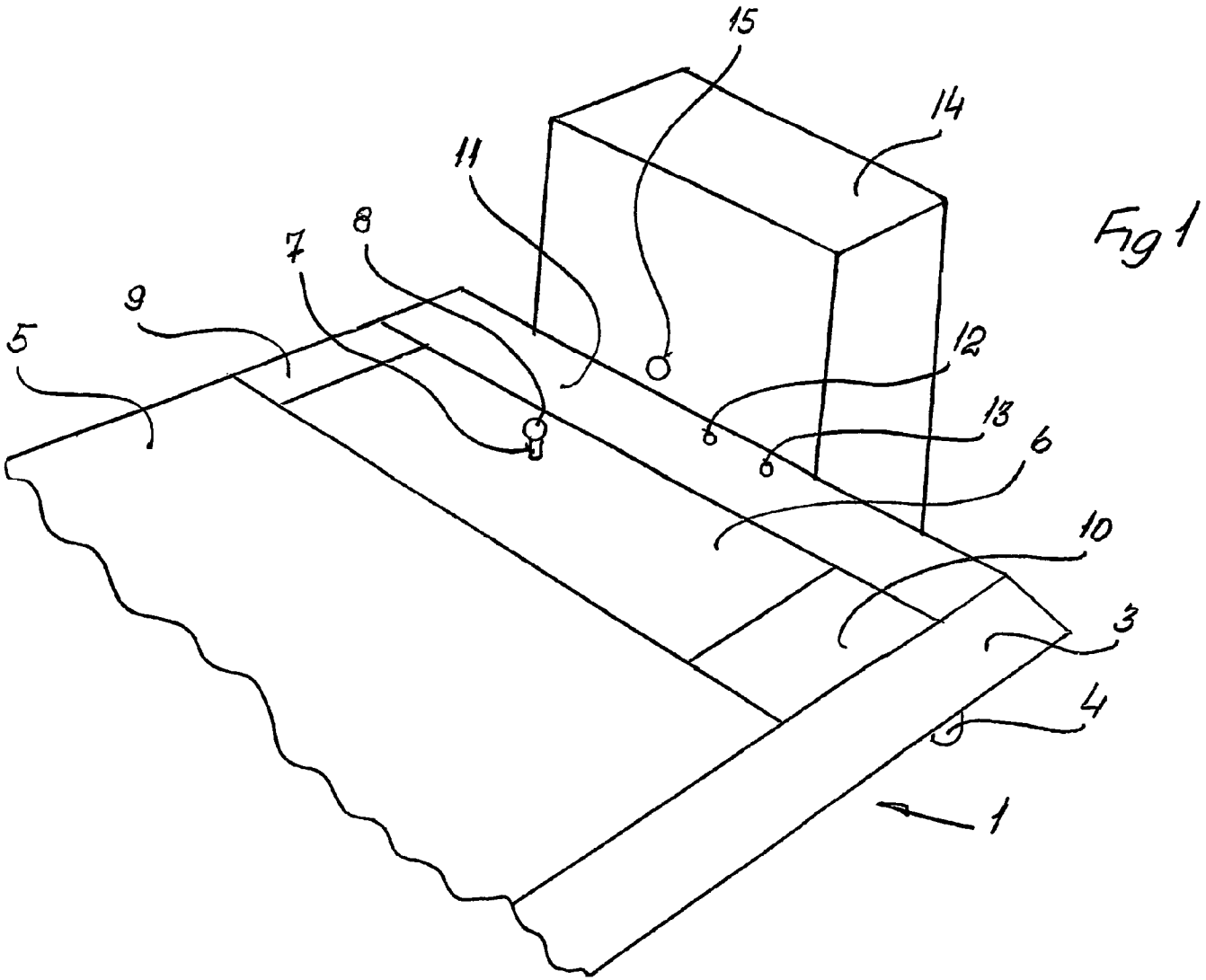
FIG. 1 is a photographic view of an apparatus according to one embodiment of the present invention at a driving tee.

One embodiment of the present invention will be described in greater detail hereinbelow in connection with use thereof at a driving tee which, as is apparent in FIG. 1, consists of a platform 1 which is raised from a substrate 2 with a frame 3 and feet 4. On the platform 1, there is placed a main mat 5 and a mat 6 through which extends the peg 7 with a ball 8. On each side of the mat section 6, there are disposed two additional mat sections 9 and 10, essentially for marking purposes. In front of the mat section 6 with the peg 7 and the ball 8, there is disposed an additional mat section 11 which is provided with holes 12 and 13 which are provided with sensors for adjusting the height of the peg 7 and thereby the height of the ball 8 above the mat 6. The sensors may, for example, be of optical and/or magnetic type and be actuable by means of a golf club or the like. The sensors are connected to electronic circuits for switching the ball support or peg level and will be described in greater detail hereinbelow.

In front of the mat section 11, there is disposed a golf ball magazine 14 which is of a conventional type and has a discharge opening 15 which is directed towards the peg 7 and which releases a golf ball on the mat section 11, whereafter the ball may roll under its own force towards the peg 7 after driving-off of the illustrated ball 8, when the peg 7 is located in its lowered position, whereafter the released ball can be placed in the opening above the peg 7 for subsequent lifting up to the desired level by means of the peg 7. A channel may be disposed in the mat sections 6 and 11, the channel not being shown, and possibly extending between the discharge opening 15 and the peg 7. As a rule, the peg 7 may be raised in that the sensor in the hole 12 is actuated by means of the player's club, and be lowered in that the sensor in the hole 13 is actuated by means of the club proper, which implies that the club face is placed quite simply above the openings 12 and 13, respectively, since the sensors therein are in all likelihood optical or magnetic, e.g. photo sensors.

The device illustrated in FIG. 2 for raising a golf ball or the pegging device, is placed under the platform 1 and has, as shown in FIG. 2, an arm consisting of two parts 31 and 32, the part 31 being secured by means of a spring plate 33 on a flange 34 and having a large U-shaped cross section with short downwardly directed shanks. The arm portion 31 further supports an adjustment member 35 with a spring F (FIG. 7), which pivots the arm portion 32 about an axis 36 counterclockwise in FIG. 2 into abutment against the inside of the arm portion 31 as long as the arm portion 32 is unbiased. Pivoting of the arm portion 32 clockwise is restricted by a bridge B between the shanks on the arm portion 31. The arm portion 31 is provided with a guide 39 for a crank 40 which is pivotal by means of a motor 41. A sensor 42 is rehearsed to decide whether a golf ball 8 is placed on the peg 7, 38, or has left the peg 7, 38. Without the loading of a golf ball 8 on the peg 7, 38, the arm portion 32 pivots to the position illustrated in FIG. 2. On placing of a ball on the peg 7, 38, the arm portion 32 will pivot clockwise in FIG. 2 and thereby downwards for actuation of the sensor 42 which indicates that a ball 8 is placed thereon, whereafter the motor 41 and the crank 40 will pivot the arm portion 31 with the arm portion 32 to the desired driving level. The driving level is adjustable with the aid of the sensors in the openings 12 and 13. These thus control the motor 41 for adjustment of the crank 40 in the desired position and thereby the arm portion 31 via suitable software and electronics. The software is suitably rehearsed to remember the set level between a number of drives, whereby it is unnecessary to carry out an adjustment between each drive, while the motor 41 returns to the same starting position, or ball collecting position, between each drive. The motor 41 may be a stepped motor.

Figures 3, 4, 5, 6, 7:
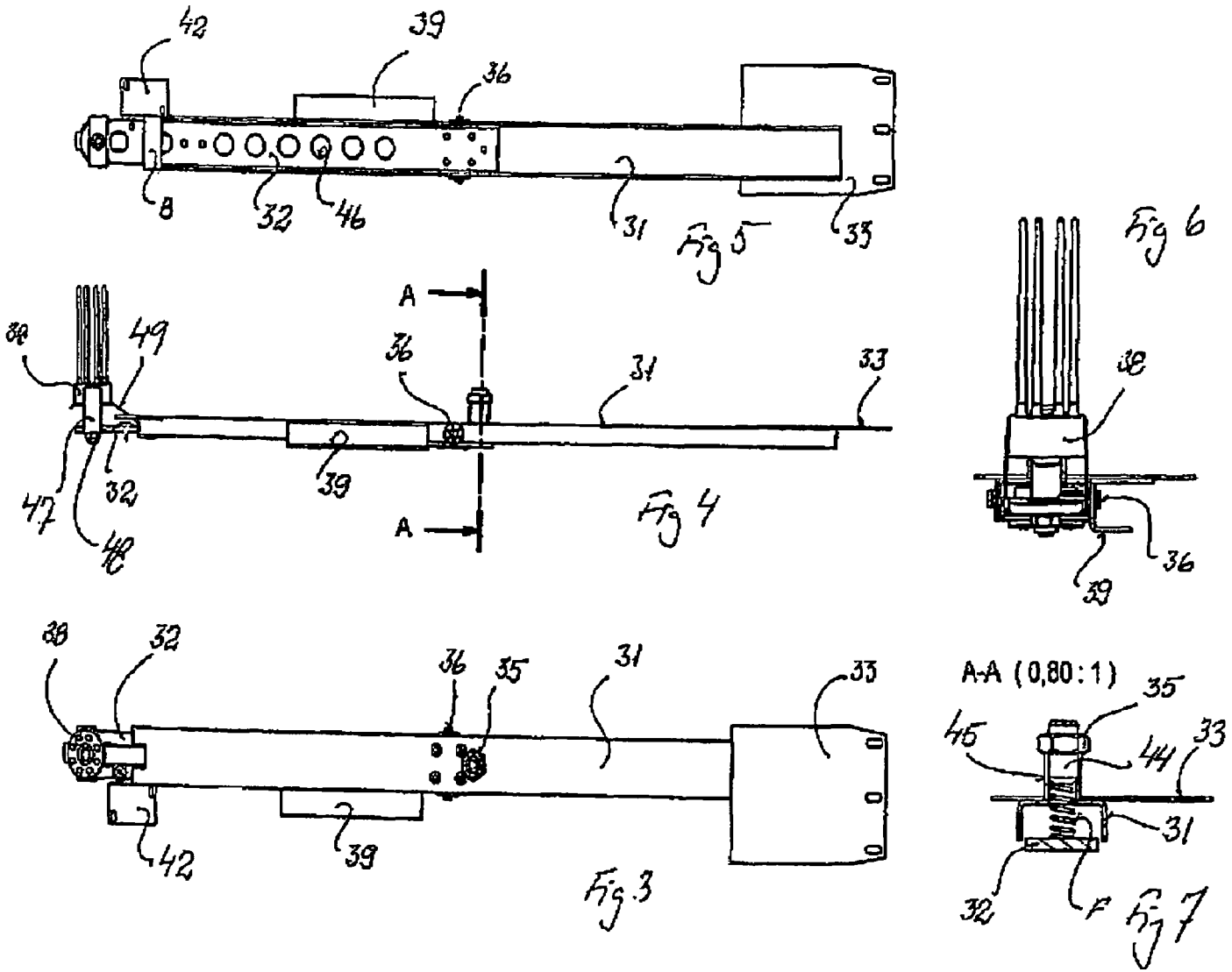
FIG. 3 is a top plan view of a ball raising device according to another embodiment of the present invention.
FIG. 4 is a side elevation of the embodiment illustrated in FIG. 3.
FIG. 5 is a view from beneath of the embodiment illustrated in FIGS. 3 and 4.
FIG. 6 is an end elevation from the left of the embodiment illustrated in FIGS. 3, 4 and 5.
FIG. 7 shows a section taken in the direction of the arrows A-A in FIG. 4.
Figure 9:
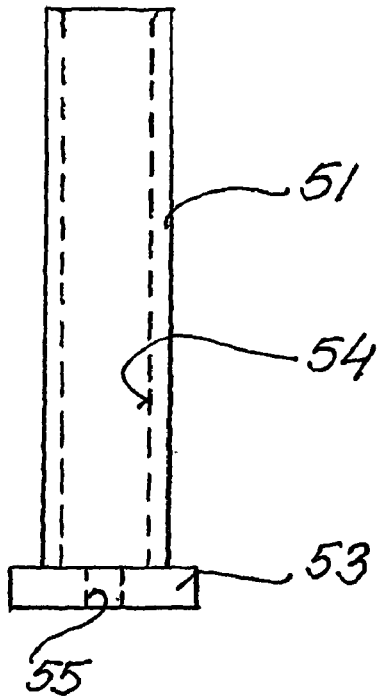
FIG. 9 is a side elevation of a part of the peg or ball support of FIG. 8.

FIGS. 3 to 7 show yet a further embodiment of parts of a ball raising- or pegging device. The same parts carry the same reference numerals. FIG. 7 shows the adjustment device in greater detail and it will be apparent that the arm portion 32 is urged down by a spring F, which in turn is compressed by means of a set screw 44 which extends through a nut 35 secured on the arm portion 31 via a tubular portion 45. It is clearly apparent from FIG. 5 that the arm portion 32 is provided with so-called weight relief holes 46. The weight relief holes may possibly be omitted if the arm portion is manufactured from such a light material as aluminium. The free end of the arm portion 32 supports a substantially U-shaped bracket 47 which, by means of a screw union 48, is secured on the arm portion 32. The bracket 47 is advantageously manufactured from a spring steel material so that the upstanding shanks are resiliently urged against the golf ball support 38 proper or the peg 7. On the inside of the upright shanks of the bracket 47, there are advantageously provided ball-shaped bulges or bights and corresponding ball-shaped bulges or bights on the golf ball support 38 or the peg 7. The bulges on the inside of the shanks of the bracket 47 may suitably consist of steel balls which are welded in position on the shanks. The inward bights on the support 38 or the peg 7 are, in such instance, recesses corresponding to the configuration of the balls. By such means, pivoting of the golf ball support 38 or the peg 7 is made possible about the axis extending between the shanks of the U-shaped bracket 47, the axis extending transversely of the longitudinal axis of the arm portions 31, 32. At the end of the arm portion 32, there is further secured a leaf spring 49 by means of a screw union (unreferenced). The spring 49 is a leaf spring and abuts against the underside of the golf ball support 38 or the peg 7 with a substantially planar portion which is substantially parallel with the arm portion 32 so that the golf ball support 38 is held in a desired position substantially at right angles to the arm portion 32. The support 38 in FIGS. 3, 4 and 6 is of a different type than the type shown in FIGS. 1 and 2, as will be described in greater detail hereinbelow.

Thus, the above-described mounting of the golf ball support 38 will permit a pivoting thereof in the longitudinal direction of the arm portions 31, 32 against the action of the leaf spring 49 which returns the golf ball support 38 or the peg 7 to the desired starting position.

This arrangement has proved to impart to the golf ball support 38 considerably improved service life. In addition, it is extremely simple to replace the golf ball support, since no tools whatever are required, but simply an outward flexing of the shanks on the U-shaped bracket 47, whereafter the leaf spring 49 is pressed down somewhat so that the bights and bulges may snap into the correct position. The bights and bulges may possibly be replaced by, for example, a pin and a corresponding recess in the mating part.

Figure 10:
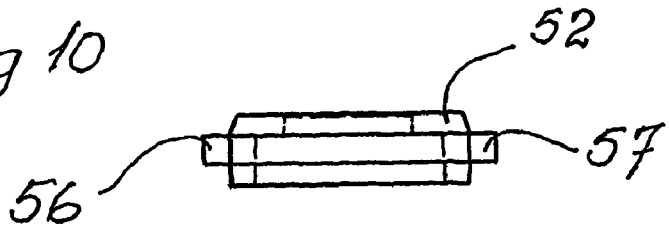
FIG. 10 is a side elevation of another part of the ball support of FIG. 8.
Figure 11:
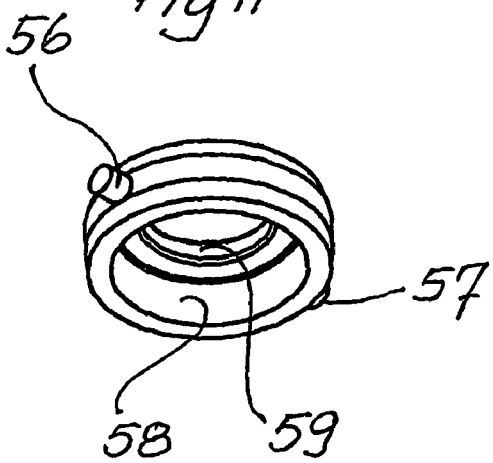
FIG. 11 is a view of the part shown in FIG. 10 obliquely from beneath.
Figure 12:
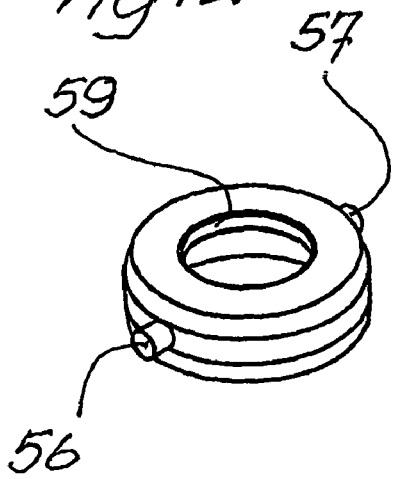
FIG. 12 is a view of the part shown in FIG. 10 obliquely from above.

FIGS. 8, 9, 10, 11, 12 and FIG. 8 show a part of FIG. 2 on a larger scale and the bracket 47 as well as the ball support 38 differ from the corresponding parts described in connection with reference to FIGS. 3 to 7. The bracket 47 is U-shaped and the upright shanks each have an L-shaped groove 50 whose horizontal section is directed away from the arm portion 32 and is open, while the vertical section of the groove 50 is closed. The ball support 38 proper is shown in greater detail in FIGS. 9 to 12 and, in this embodiment, consists of an upright 51 (FIG. 9) and a cradle 52 (FIGS. 10 to 12). The upright 51 is cylindrical and has a foot 53 in a part with the upright 51 proper, which has a through-going hole 54 and is thus tubular. The foot 53 has a hole 55 for the draining of any possible water. The cradle 52 in FIGS. 10 to 12 is cup-shaped and has two mutually registering pins 56 and 57. The cradle 52 has a recess 58 and a hole 59 for the upright 51. The foot 53 fits in the recess 58 and the upright 51 fits in the hole 59. The pins 56 and 57 each fit in their one of the grooves 50.

It is clearly illustrated in FIG. 8 that the leaf spring 49 urges the cradle 52 with the upright 51 by abutting against the foot 53 and possibly also the cradle 52, or both against the foot 53 and the cradle 52 against the closed end of the vertical section of the groove 50.

Also in this embodiment, the ball support 38 will be pivotal in the longitudinal direction of the arm portions 31 and 32 and is extremely simple to replace, and the risk that it is removed unintentionally is extremely slight.

Many modifications are naturally possible without departing from the scope of the inventive concept as this is defined in the appended Claims.

The invention claimed is:

1. An apparatus at a driving tee for golf balls, comprising:

a raisable and lowerable ball support a so-called peg, on which a ball may be placed for driving thereof after lifting of the ball, support with the ball to a desired level above the tee, the ball support being disposed on means for switching of the ball support from a low position for loading of the ball support with a ball to a higher position of said desired ball driving level, the ball support being disposed on the switching means via positioning means which is disposed to permit pivoting of the ball support in at least the driving direction, wherein the positioning means includes a substantially U-shaped bracket between whose shanks the ball support is pivotal, and wherein the positioning means further includes a leaf spring which extends between the shanks of the substantially U-shaped bracket and strives to hold the ball support in a starting position.

2. The apparatus as claimed in claim 1, wherein the switching means includes a first arm portion and a second arm portion of substantially the same extent as the first arm portion, the second arm portion supporting the ball support at one end and being pivotal in relation to the first arm portion.

3. The apparatus as claimed in claim 2, wherein the substantially U-shaped bracket is secured at the end by the second arm portion which extends through the bracket.

4. The apparatus as claimed in claim 1, wherein the leaf spring is secured at an end of an arm portion and extends between the shanks of the substantially U-shaped bracket for abutment against the underside of the ball support.

5. An apparatus at a driving tee for golf balls, comprising:

a raisable and lowerable ball support a so-called peg, on which a ball may be placed for driving thereof after lifting of the ball support with the ball to the desired level above the tee, the ball support being disposed on means for switching of the ball support from a low position for loading of the ball support with a ball to a higher position of said desired ball driving level, the ball support being disposed on the switching means via positioning means which is disposed to permit pivoting of the ball support in at least the driving direction, wherein the positioning means includes a substantially U-shaped bracket between whose shanks the ball support is pivotal;

wherein the ball support includes a cradle and a cylindrical portion which extends through the cradle and whose end is formed for a ball;

wherein the cradle has two mutually registering pins for cooperation with a groove in each one of the shanks of the U-shaped bracket; and wherein the groove is L-shaped with the vertical shank oriented in the longitudinal direction of the longitudinal axis of the cylindrical portion and the leaf spring is disposed to urge the cradle with the ball support against the end of the L-shaped groove at the top of the vertical shank of the L-shaped groove, while the end of the horizontal shank of the L-shaped groove is open so as to permit insertion of the pins on the cradle in the vertical section of the L-shaped groove via the horizontal section of the L-shaped groove.

6. The apparatus as claimed in claim 1, wherein the ball support includes a cradle and a cylindrical portion which extends through the cradle and whose end is formed for a ball.

7. The apparatus as claimed in claim 4, wherein the ball support includes a cradle and a cylindrical portion which extends through the cradle and whose end is formed for a ball.

* * * * *